US006105564A

United States Patent [19]

Suppan

[11] Patent Number: 6,105,564

[45] **Date of Patent: *Aug. 22, 2000**

[54] BOW WITH LIMBS

[76] Inventor: Herbert Suppan, Südstadt 7/7, A-8330 Feldbach, Steiermark, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 09/065,120

[22] Filed: Apr. 23, 1998

[30] Foreign Application Priority Data

Dec. 19, 1997 [AT] Austria ..... 2147/97

[51] Int. Cl.[7] ..... F41B 5/00; F41B 5/20

[52] U.S. Cl. ..... 124/23.1; 124/89

[58] Field of Search ..... 124/23.1, 89

[56] References Cited

U.S. PATENT DOCUMENTS

| | | | |
|---|---|---|---|
| 1,877,273 | 9/1932 | Cowdery | 124/23.1 |
| 1,960,477 | 5/1934 | Cowdery | 124/23.1 |
| 3,757,761 | 9/1973 | Izuta | 124/89 X |
| 4,088,111 | 5/1978 | Li | 124/23.1 |
| 4,122,821 | 10/1978 | Mamo | 124/23.1 |
| 5,524,602 | 6/1996 | Papandrea et al. | 124/89 |
| 5,617,664 | 4/1997 | Troncoso | 124/89 X |

FOREIGN PATENT DOCUMENTS

| | | | |
|---|---|---|---|
| 2234184A | 1/1991 | United Kingdom | 65/526 F |

*Primary Examiner*—John A. Ricci
*Attorney, Agent, or Firm*—Volpe & Koenig, P.C.

[57] ABSTRACT

The invention relates to a bow with limbs which have a curved cross-section and whose longitudinal edges are oriented in a direction away from the bowstring, the cross-section of the limb (2, 3) extending with continuous curvature between the bow edges (2', 3'), at least in the tensioned state.

5 Claims, 2 Drawing Sheets

BOW WITH LIMBS

BACKGROUND OF THE INVENTION

1. Field of the Invention

The invention relates to a bow having limbs which have a curved cross-section and whose longitudinal edges are turned away from the bowstring.

2. Description of the Related Art

In an embodiment disclosed in German Patent DE 27 16 586 A1, the bow has a wave-like cross-section in which the longitudinal edges of the bow are provided with members for absorbing the tensioning forces. Such an embodiment has the drawback that, during drawing of the bow, the waves can fold together like an accordion so that, upon forceful pulling, the longitudinal edges can be displaced beyond the center and this can sometimes cause buckling of the bow. In addition, upon increased pull on the bowstring, the bow becomes progressively more yielding than in its initial state.

SUMMARY OF THE INVENTION

The invention is predicated on the task of providing a bow of the previously described kind which is resistant to lateral deformation or buckling and by means of which, on the other hand, high arrow velocities are produced.

This task is accomplished in accordance with the invention by providing, at least in the drawn state, a limb cross-section having a continuous curvature between the edges of the bow. As a result there occurs a two-way movement during drawing of the bow, namely bending of the bow itself, on the one hand, and lateral spreading-apart of the longitudinal edges, on the other hand, such that the release movement proceeds in predetermined manner, namely by straightening of the bow itself with simultaneous forward movement of the edges relative to the bottom of the bow, thereby achieving faster restoration of the bow to its initial state, which leads to increased projection velocity for the bow. In addition, the bow becomes stiffer during drawing of the bowstring, which also creates increased arrow velocity.

Preferably, the shape and/or degree of the curvature can vary over the lengthwise dimension of the limb. In so doing, the degree of curvature of the limb can be made variable as a function of the degree of tension in the bow, so that the distribution of the curvature both along the longitudinal axis and transverse to the longitudinal axis yields a uniform distribution of tension over the entire bow cross-section.

To prevent the formation of a so-called stop shock (shock wave) in the bowstring upon release of the bowstring, i.e. during loosing of the arrow, which is accompanied by powerful vibrations of the string, the bow can be provided, at least in the vicinity of the root of the limb, with one or more stabilizers formed by coil springs. Such coil springs are able to store more energy than conventional linear or hydraulic stabilizers, i.e. they can compensate more of the occurring vibrations. To enhance the compensating capability of the stabilizers, the coil springs can be filled with vibration damping material. For the same purpose, there can be placed inside each of the stabilizer-forming coil springs, an additional coil spring, which can also absorb corresponding vibrations.

The drawings show an illustrative example of the inventive subject matter.

DETAILED DESCRIPTION

Figure 3:
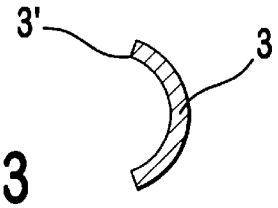
FIG. 3 is a cross-section along line III—III of FIG. 1.
Figure 4:
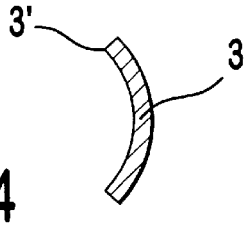
FIG. 4 is a cross-section along line IV—IV of FIG. 2.
Figure 5:
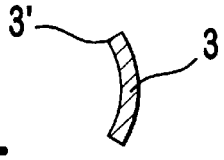
FIG. 5 illustrates a cross-section along line V—V of FIG. 1.
Figure 6:
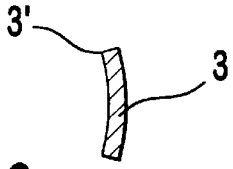
FIG. 6 is a cross-section along line VI—VI of FIG. 2.

Bow 1 consists of two limbs 2, 3, having the same configuration and extending from a central portion 4. As is apparent from FIGS. 3 to 6 the limbs 2, 3 have a dish-shaped curved cross-section. Also apparent from these figures is that the curvature varies along the length of the bow limb. It is further apparent, especially by comparing FIG. 3 with FIG. 4, or FIG. 5 with FIG. 6, that upon tensioning of the bow, i.e. when the limbs are bent to the rear through rearward drawing of the bowstring 5 which connects the ends of the limbs, they exhibit a different radius of curvature, or curvature shape, than in the state in which they are only pretensioned by the bowstring 5.

The forward edges 2', 3' of the limbs are defined by the forwardly oriented free edges of the generally dish-shaped bent limbs.

Figure 7:
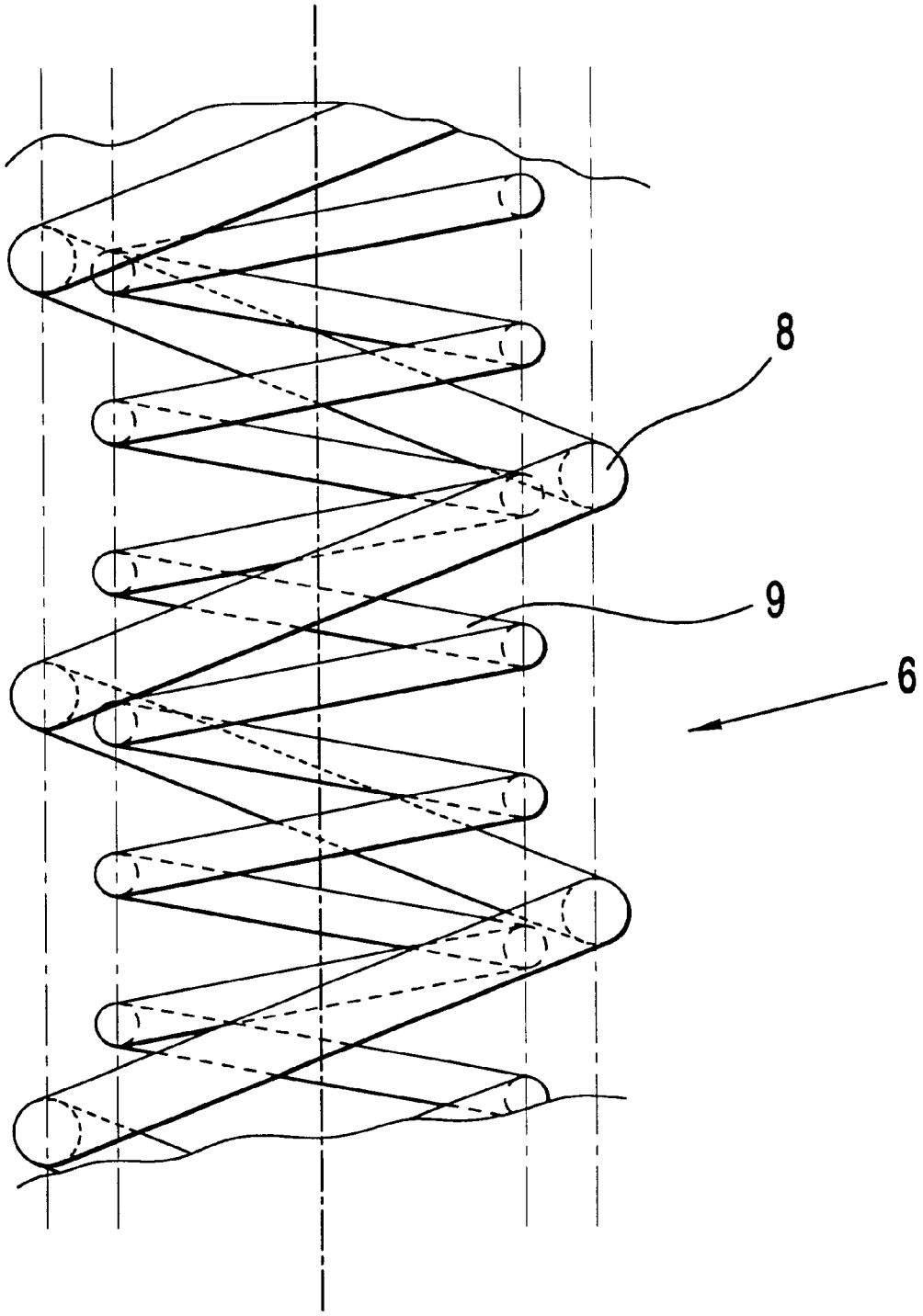
FIG. 7 is a fragmentary view of the stabilizer according to VII in FIGS. 1 and 3.

Stabilizers are designated by numerals 6 and 7 and, as shown in more detail in FIG. 7, are formed by coil springs 8, with the interior of the coil spring 8 having an additional coil spring 9 placed inside. In lieu of the inner coil spring 9 there could also be used other oscillation damping materials as, for example, rubber, foam and the like, or other compressible fluids. Both stabilizers can be alike, or can be filled differently.

Figure 1:
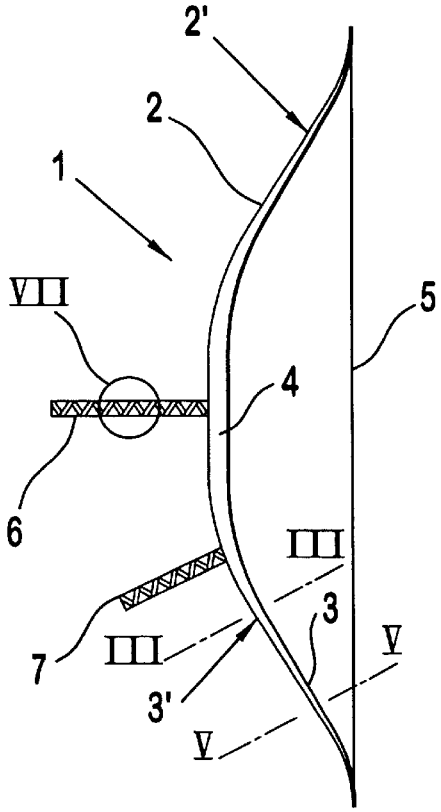
FIG. 1 shows the bow according to the invention, pretensioned (braced) by the bowstring.
Figure 2:
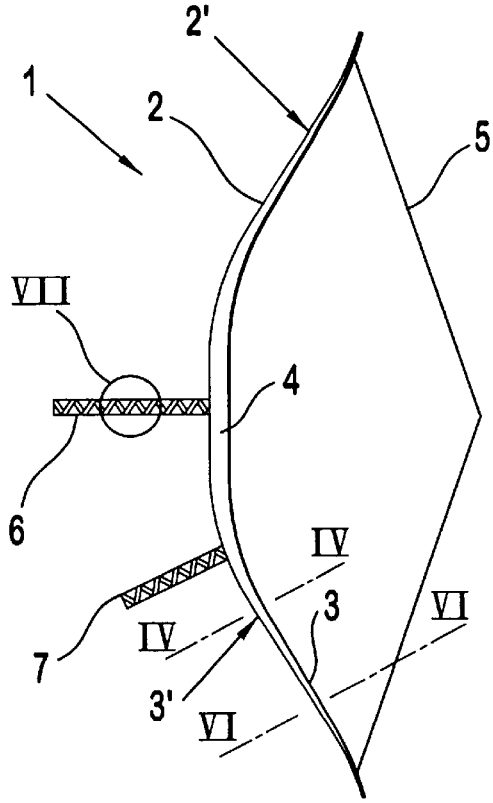
FIG. 2 represents the bow tensioned for shooting.

Upon tensioning the bow for shooting, i.e. by shifting the bow from the state illustrated in FIG. 1 to that in FIG. 2, the limbs 2, 3 are bent toward the user, whereupon the curvature of the limbs flattens due to the applied forces, namely as a function of the bending force. Since the curvature of the bow limbs differs in degree at different points along the length of the bow (section lines III/III, IV/IV or V/V, VI/VI), the tensioning of the bow causes a varying bending of the limbs, whereby the flattening of the curvature also proceeds variably, as can be seen from a comparison of FIGS. 3–6. By relaxing the bow tension, i.e. upon shooting, the bowstring 5 snaps from the position shown in FIG. 2 to that in FIG. 1, with the elasticity of the limbs acting both along their longitudinal axes and transversely thereto, because the bow limbs seek to revert to their state of rest, on the one hand, and because the curvature of the bow cross-section also seeks to resume its initial configuration, on the other hand, and because the automatic increase in curvature also initiates a straightening of the limbs, i.e. a movement in the direction of tension release.

After the arrow has been loosed there develops a so-called stop shock (shock wave) in the bowstring 5, i.e. a jolt-like tensioning of the bowstring, which leads to vibrations of this bowstring that can be transmitted to the bow and be detrimental to the initial flight of the arrow. This should be prevented, especially in sport and high performance bows, because it causes the aiming accuracy to decline substantially. To compensate for these vibrations, stabilizers are conventionally provided, namely rigid rods or the like, which compensate for the bowstring vibrations by means of their own self- or counter-oscillations. In the present instance, the stabilizers take the form of coil springs, which are sufficient by themselves, if they have the appropriate dimensions. To dampen the vibrations even more strongly it is possible to place, inside the coil spring 8, an additional coil spring 9 which can compensate for additional vibratory oscillations by virtue of its different oscillatory characteristics. In lieu of this inner spring 9, other compensating materials, not illustrated, can also be placed inside spring 8.

What is claimed is:

1. A bow having a central portion and limbs having roots at said central portion, said limbs having a curved cross-section and longitudinal edges which are oriented in a direction away from the bowstring, at least in the tensioned state the cross-section of the limbs being continuously curved between the limb edges, and at least in the vicinity of said roots being provided with one or more stabilizers which are formed by coil springs, the interior of at least one said coil spring forming a stabilizer being filled with oscillation damping material.

2. A bow having a central portion and limbs having roots at said central portion, said limbs having a curved cross-section and longitudinal edges which are oriented in a direction away from the bowstring, at least in the tensioned state the cross-section of the limbs being continuously curved between the limb edges, and at least in the vicinity of the limb roots the bow being provided with one or more stabilizers which are formed by coil springs, and an additional coil spring being placed inside each said coil spring forming a stabilizer.

3. The bow according to claim 2, wherein each said additional coil spring has a different oscillatory characteristic than the coil spring inside which it is placed.

4. The bow according to claim 3, wherein the said coil springs are the only stabilizers for the bow.

5. The bow according to claim 4, wherein no weights separate from the coil springs are provided as stabilizers.

* * * * *